United States Patent [19]

Bridges

[11] 4,031,346

[45] June 21, 1977

[54] ELECTRICAL INTERRUPTER SWITCH

[76] Inventor: Ronald P. Bridges, 9 South 681 Brookeridge Road, Downers Grove, Ill. 60515

[22] Filed: Oct. 20, 1975

[21] Appl. No.: 623,792

[52] U.S. Cl. ..... 200/146 R; 200/48 R

[51] Int. Cl.[2] ..... H01H 33/12

[58] Field of Search ..... 200/146 R, 48 R, 48 A

[56] References Cited

UNITED STATES PATENTS

| | | | |
|---|---|---|---|
| 3,080,466 | 3/1963 | Froland | 200/146 R |
| 3,172,979 | 3/1965 | Yonkers | 200/146 R |
| 3,205,330 | 9/1965 | Bridges | 200/146 R |
| 3,838,233 | 9/1974 | Bridges | 200/48 R |

*Primary Examiner*—Robert S. Macon
*Attorney, Agent, or Firm*—Wegner, Stellman, McCord, Wiles & Wood

[57] ABSTRACT

An electrical disconnect switch and circuit interrupter has an interrupter with an elongate tubular housing assembly that mounts on a fixed contact structure of the switch and has an internal fixed interrupter contact electrically connected to said fixed contact structure. A movable interrupter contact that normally abuts the fixed interrupter contact has a conductive actuating rod that slides in an apertured plug in one end of the housing assembly and has an actuating catch at its outer end, and a fixed conductive catch on the housing is electrically connected to the rod through the plug. An operating arm on a pivoted movable contact structure of the switch engages the catches sequentially as it is moved from closed position, first completing a by-pass circuit through the fixed catch and then pulling the actuating rod to separate the interrupter contacts. The arm ultimately rides off the actuating catch and a spring returns the movable interrupter contact to its normal position.

28 Claims, 6 Drawing Figures

21
20
10
11
12
23
30
43a
34a
34
36
33
37
43
53
48
47
13
14
49
15
52
45
16

20
48
46
30
43
33
34a
34b
34
37d
37a
37c
37b
37

32
21
20
10
11
12
23
30
14
34
33
36
13
22
53
49
43
13
43a
52
37a
37
15
16
16

10
12
25
26
18
19
24
23
20
29
28
35
27
30a
21
30
36
31a
31
32a
39
32
38a
38
40
50
46
48
33b
43
33
33a
22
13
37d
37a
37c
37
37b
16

ELECTRICAL INTERRUPTER SWITCH

BACKGROUND OF THE INVENTION

Bridges U.S. Pat. No. 3,205,330, issued Sept. 7, 1965, discloses an electrical circuit disconnect switch and interrupter which has enjoyed great commercial success. However, it has electrical interrupting capabilities which are much greater than are actually needed for many applications.

The circuit interrupter of the present application is adapted to be used with a switch of the type disclosed in Bridges U.S. Pat. No. 3,838,233, issued Sept. 24, 1974, with switch modifications to provide for mounting and actuation of the interrupter. The interrupter of the present invention is much more economical to manufacture than is the interrupter of U.S. Pat. No. 3,205,330; but it nevertheless provides ample electrical capability for interrupting load currents up to 600 amps at 15.5 KV. The circuit interrupter switch of U.S. Pat. No. 3,205,330 can be used to open electric circuits operating as high as 35 KV

SUMMARY OF THE INVENTION

The principle object of the present invention is to provide a load interrupter switch which is usable in the range up to 15.5 KV and 600 amps or slightly more; and which is relatively inexpensive to manufacture.

Another object of the invention is to provide such a load interrupter switch which is of sufficiently light weight that it may be suspended from an electrical power transmission line.

Still another object of the invention is to provide an electrical circuit interrupter which may be mounted upon and used with disconnect switches of the type disclosed in U.S. Pat. No. 3,838,233, with very minor modifications of such switches.

Still another object of the invention is to provide an electrical circuit interrupter switch in which the interrupter member is of very rugged and simple construction, and inexpensive to manufacture.

Another object of the invention is to provide an electrical circuit interrupter switch which permits easy removal and replacement of the interrupter member.

Still another object of the invention is to provide an electrical circuit interrupter switch which may be used as a gang operated switch or as a hook-stick operated switch.

THE DRAWINGS

Figure 1:
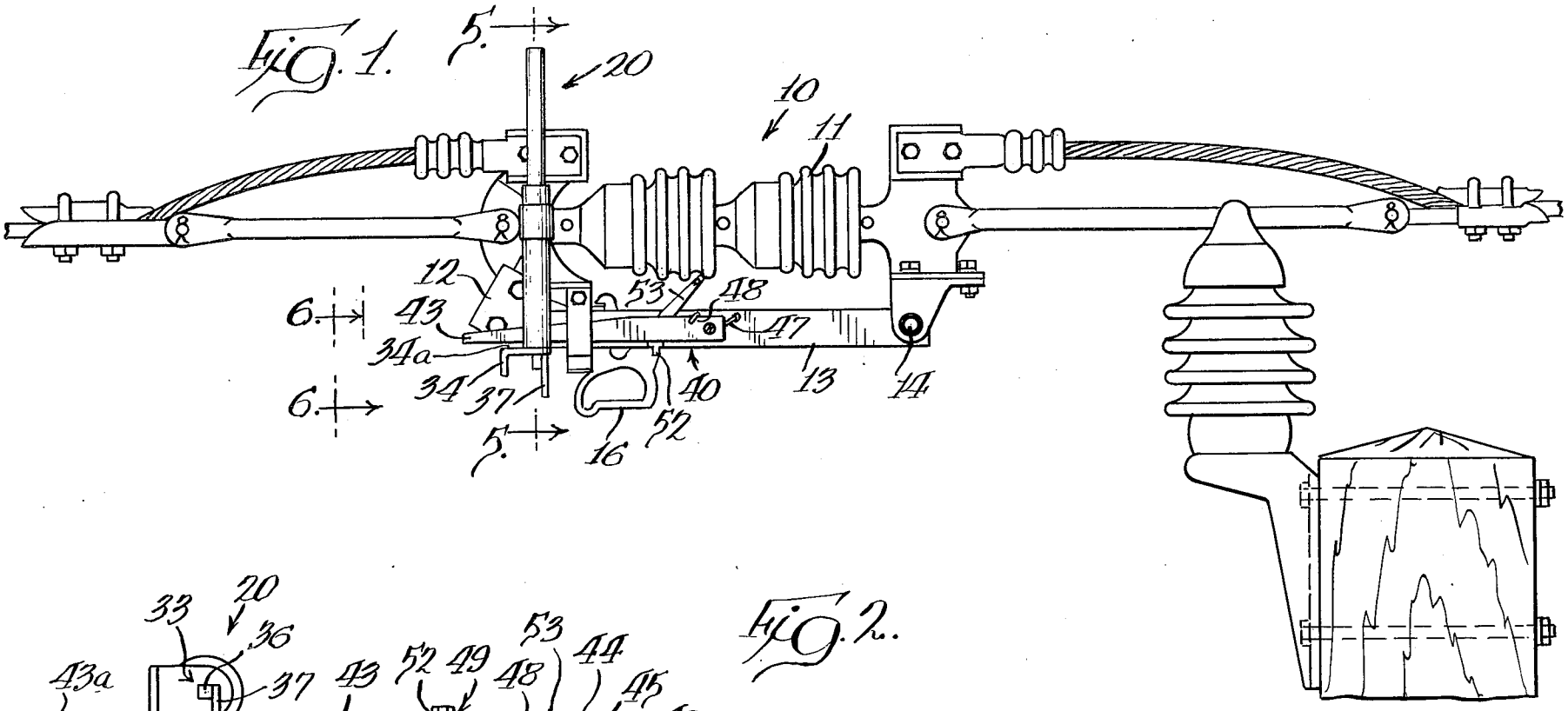
FIG. 1 is a side elevational view of an electrical circuit interrupter switch embodying the present invention, mounted upon an electrical distribution line, and with a movable switch structure of the interrupter switch in closed position.
Figure 6:
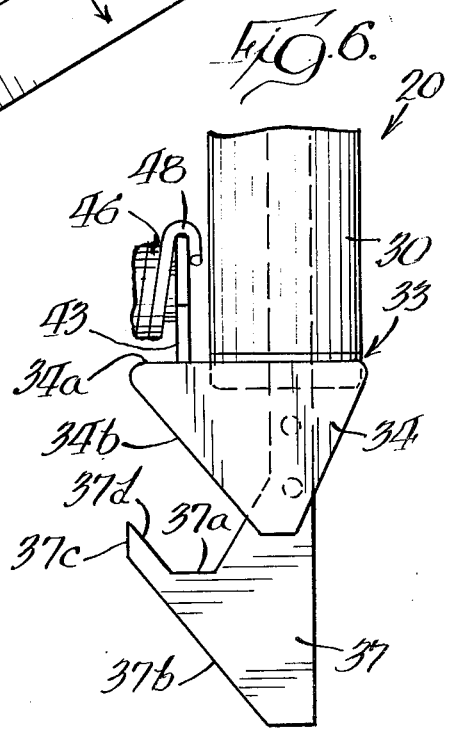
Figure 4:
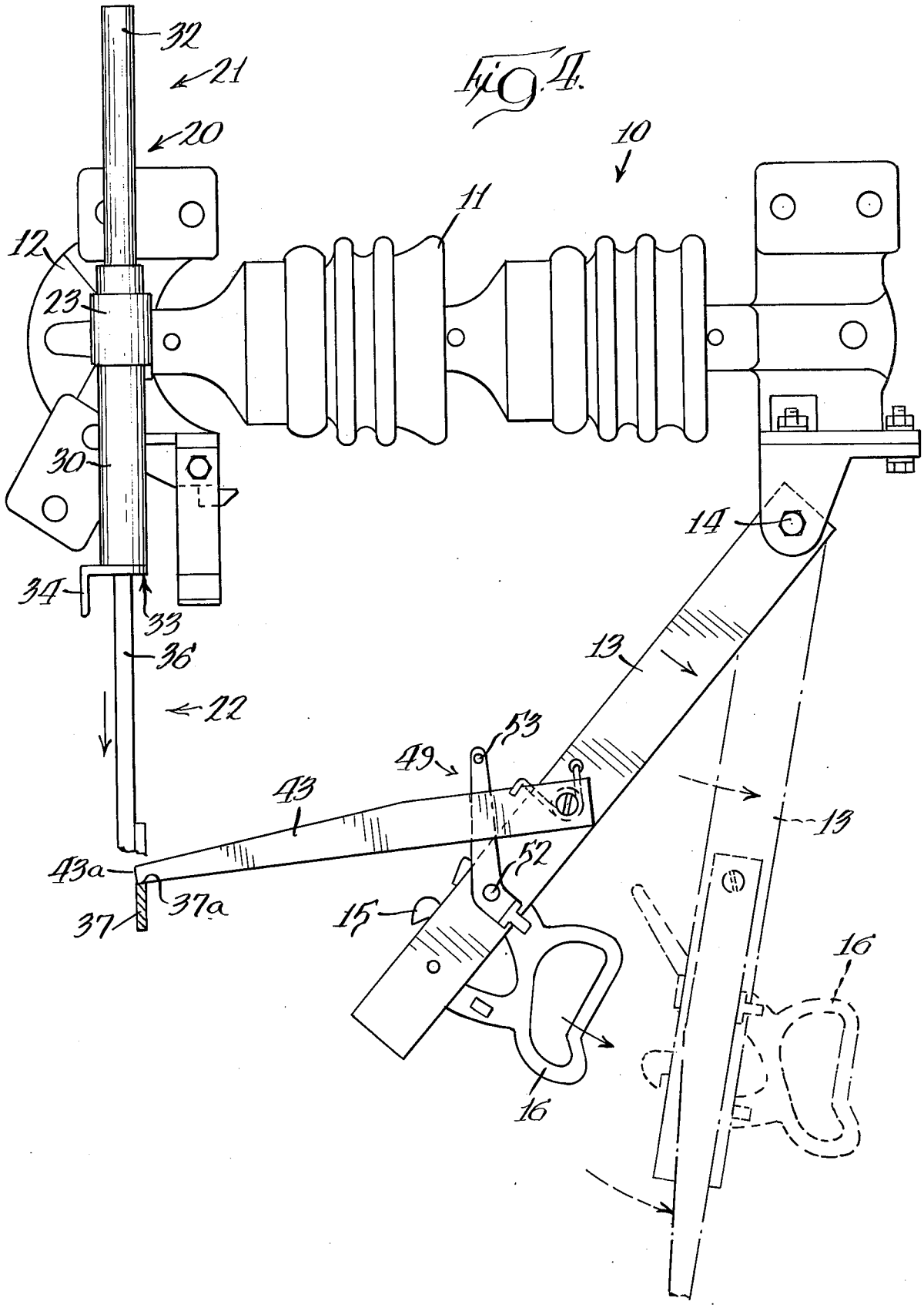
FIG. 4 is a view similar to FIG. 3, with parts broken away and sectioned for clarity, shown just before the interrupter operating arm releases the interrupter actuating catch, with the movable switch structure illustrated in its final open position in broken lines.
Figure 5:
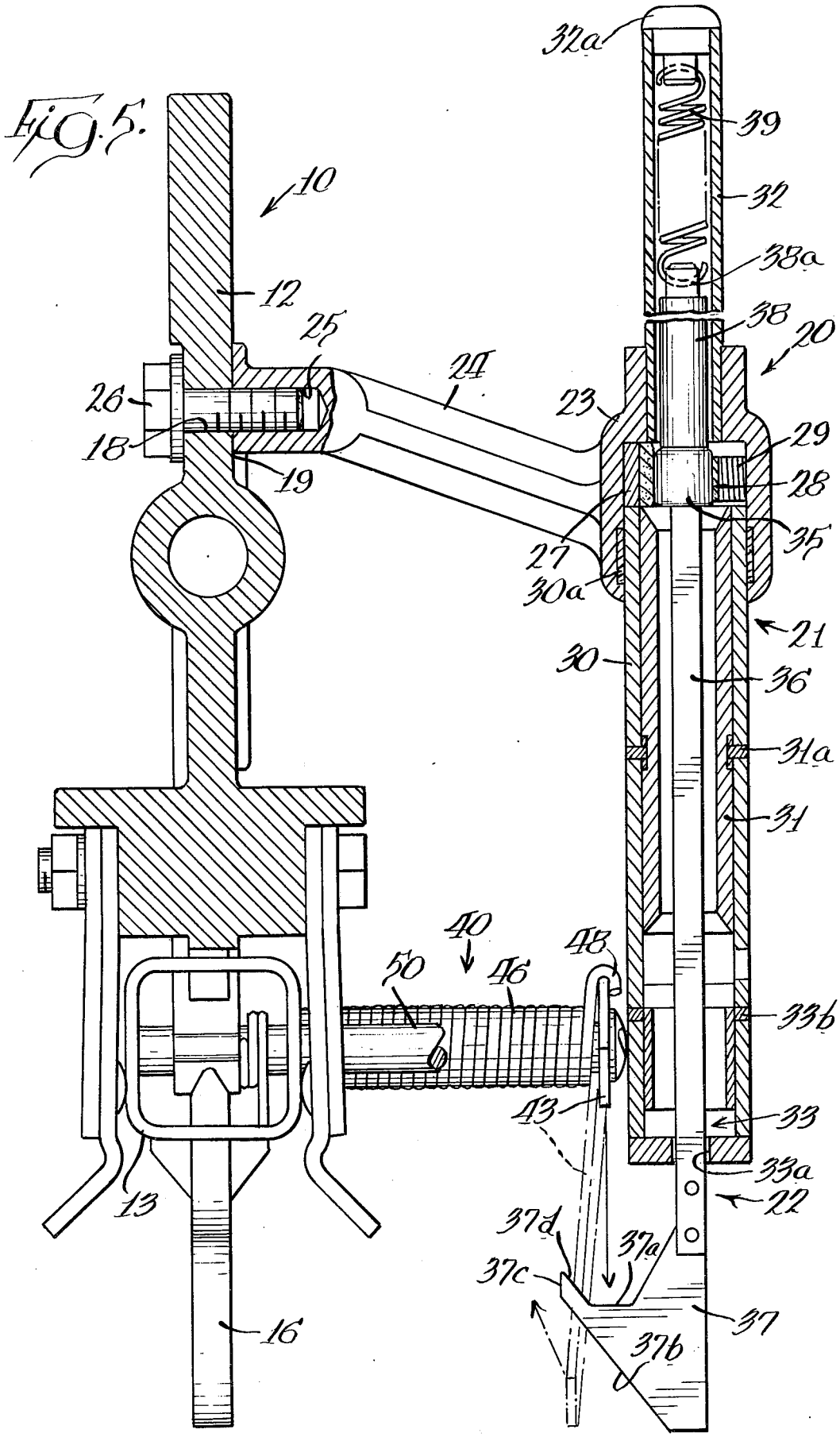

FIG. 5 is a sectional view on an enlarged scale taken substantially as indicated along the line 5—5 of FIG. 1, with a broken line showing of the interrupter operating arm in the position it occupies as the movable switch structure is returned from the position of FIG. 4 to the position of FIG. 1 and with arrows indicating the paths of movement of the operating arm in both directions, and with the connection to power line and the insulators of the switch body omitted for clarity; and FIG. 6 is a fragmentary elevational view of the lower end portion of the interrupter, taken substantially as indicated along the line 6—6 of FIG. 1.

DETAILED DESCRIPTION OF THE INVENTION

Figure 2:
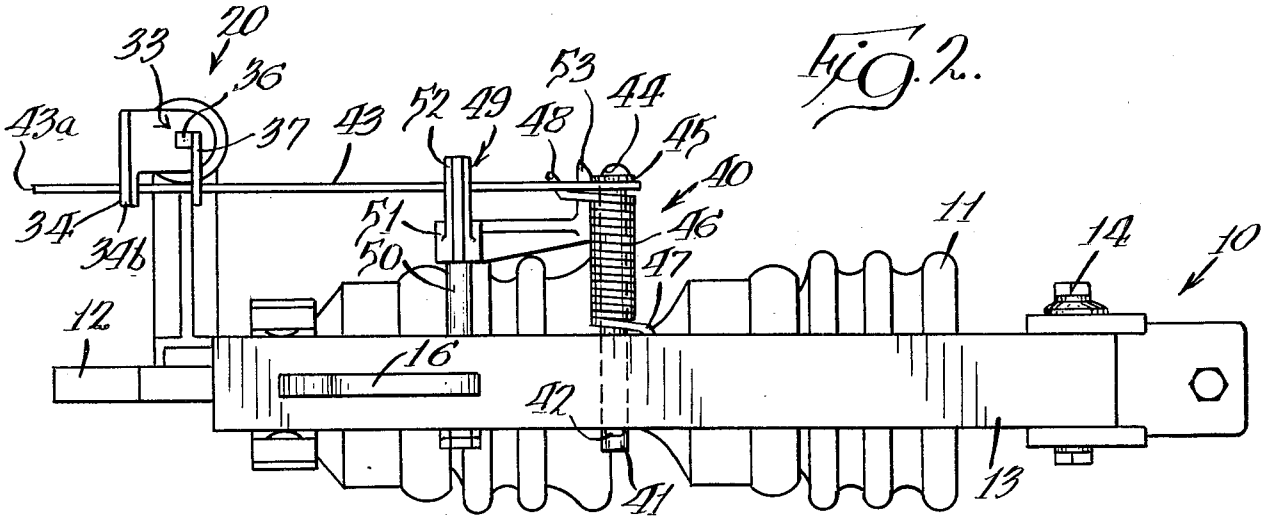
FIG. 2 is a bottom plan view of the structure of the invention on an enlarged scale.

Referring to the drawings in detail, the referring first to FIGS. 1, 2 and 5, the structure of the present invention includes a disconnect switch, indicated generally at 10; a circuit interrupter structure, indicated generally at 20; and interrupter operating means, indicated generally at 40.

The disconnect switch 10 is constructed and mounted in accordance with the disclose of U.S. Pat. No. 3,838,233, to which reference is made for a detailed description of the construction. For purposes of the present disclosure, it is sufficient to identify the switch body 11, a fixed contact structure 12, and a movable contact structure 13 which is pivotally mounted at 14 on the switch body 11. The movable contact structure 13 includes a spring loaded latch 15 (FIG. 3) which normally retains said movable contact structure in the closed circuit position of FIG. 1 and which is provided with latch operating means that includes a ring 16 which may be engaged by a hook-stick to disengage the latch 15 and move the movable contact structure from the closed circuit position of FIG. 1 through the position of FIG. 3 and the full line position of FIG. 4 to the broken line position of FIG. 4.

When the device is to be used as a gang operated switch, the operating ring 16 is omitted and suitable gang operating mechanism is substituted such, for example, as the operating mechanism of Bridges U.S. Pat. Nos. 3,637,959 or 2,825,774.

Referring now particularly to FIG. 5, the fixed contact structure 12 includes a mounting pad 17 aligned with which there is a hole 18 to permit mounting of the interrupter structure 20 upon the fixed contact member 12. The interrupter 20 includes a cylindrical housing assembly, indicated generally at 21, and a movable interrupter contact assembly, indicated generally at 22.

The housing assembly 21 includes a short, cylindrical housing 23 which is fabricated from aluminum alloy and has an integral mounting bracket 24 that has a tapped blind bore 25 in its outer end to receive a mounting bolt 26 by means of which the interrupter 20 is detachably secured to the fixed contact structure 12 of the switch. Within the cylindrical housing 23 is a fixed electrical contact 27 which is in the form of a ferrule which has one side cut out to receive a flat spacer member 28 of a phenolic resin behind which is a compression spring 29. The housing assembly 21 also includes a tubular end shell 30 of fiberglass reinforced epoxy resin in which a liner 31 of extruded acrylic resin tubing is secured by means of an epoxy resin insert **31*a* which is injected through a hole in one side of the end shell 30, fills a circumferential groove in the liner, and out a vent hole in the opposite side of the end shell 30. The liner 31** is of a material which forms an arc quenching gas when it is subjected to an electric arc pulled within the housing when the interrupter is operated, as is well known in the art.

The end shell 30 is secured in one open end of the housing 23 by means of an epoxy ring 30*a* which is injected through a hole in one side of the housing 23, and which flows around an annular recess in the housing 23 and out a vent hole on the opposite side of the housing. At the end of the housing 23 opposite the end shell 30 is an aluminum bottom tube 32 which is press fitted into the housing.

In the open end of the end shell 30 is an aluminum alloy guide, indicated generally at 33, which provides a plug for the end shell that has a central square hole 33*a* which serves as a guide for the movable interrupter contact assembly 22. The guide 33 is mounted in the end shell 30 by means of epoxy resin 33*b* which is injected through a hole in one side of the end shell, flows around an external, annular recess in the guide, and out a hole on the opposite side of the end shell. Referring again to FIGS. 1 to 4, formed integrally with the guide 33 is a catch 34 which is best seen in FIG. 6 to have a planar upper surface 34*a* and an inclined lower camming surface 34*b*.

The movable contact assembly 22 includes a movable electrical contact member 35, a square actuating rod 36 of aluminum alloy which extends through and is guided in the square hole 33*a* of the guide member 33. At the outer end of the actuating rod 36 is an actuating catch 37 which has an upper planar surface 37*a* and a lower inclined cam surface 37*b*, and said two surfaces are seen to be parallel, respectively, to the surfaces 34*a* and 34*b* of the fixed catch 34. A lip 37*c* on the catch 37 provides an inclined guide and confining surface 37*d*.

At the opposite end of the movable interrupter contact 35 is a trailer 38 of nylon rod which is firmly connected to the movable interrupter contact and which has a spring keeper 38*a* at its upper end to receive one end of a soft tension spring 39 the opposite end of which is anchored to a cap 32a which is press fitted into the aluminum tube 32. The spring has 321½ active coils of 0.025 inch 18–8 stainless steel wire, the spring rate being 0.22 pounds/inch, the initial tension approximately 0.1 pound and the maximum load approximately 1.0 pounds. Thus, the spring 39 provides a soft return for the movable interrupter contact assembly 22 when it is displaced downwardly from the normal position of FIG. 5 which the movable interrupter contact 35 is held in firm electrical contact with the fixed interrupter contact 27 by the compression spring 29 and spacer 28.

The interrupter operating assembly 40 is best seen in FIGS. 2 and 5 to consist of a mounting post 41 which extends through a pair of aligned holes in the side walls of the hollow, square movable contact assembly 13, and which is retained by a cotter pin 42. An interrupter operating arm 43 has one end portion seated upon a shoulder at the outer end of the post 41, and is held in place by a machine screw 44 and washer 45. The interrupter operating arm 43 is parallel to the movable contact structure 13 and aligned with the fixed catch 34 of the interrupter and with the actuating catch 37 of the movable interrupter contact assembly 22. A torsion spring 46 which surrounds the post 41 has one end 47 anchored in a hole in the adjacent side of the movable contact structure 13, and has its opposite end 48 hooked around the upper end of the interrupter operating arm 43. The torsion spring 46 is fabricated from 0.105 diameter 18–8 stainless steel and has 17½ active turns at a spring rate of 25.6 in.-lbs/rev. Thus, it provides a substantial force biasing the operating arm 43 in the direction of movement of the movable contact structure 13 as the latter moves from the closed position of FIG. 1 to the open, broken line position of FIG. 4.

Figure 3:
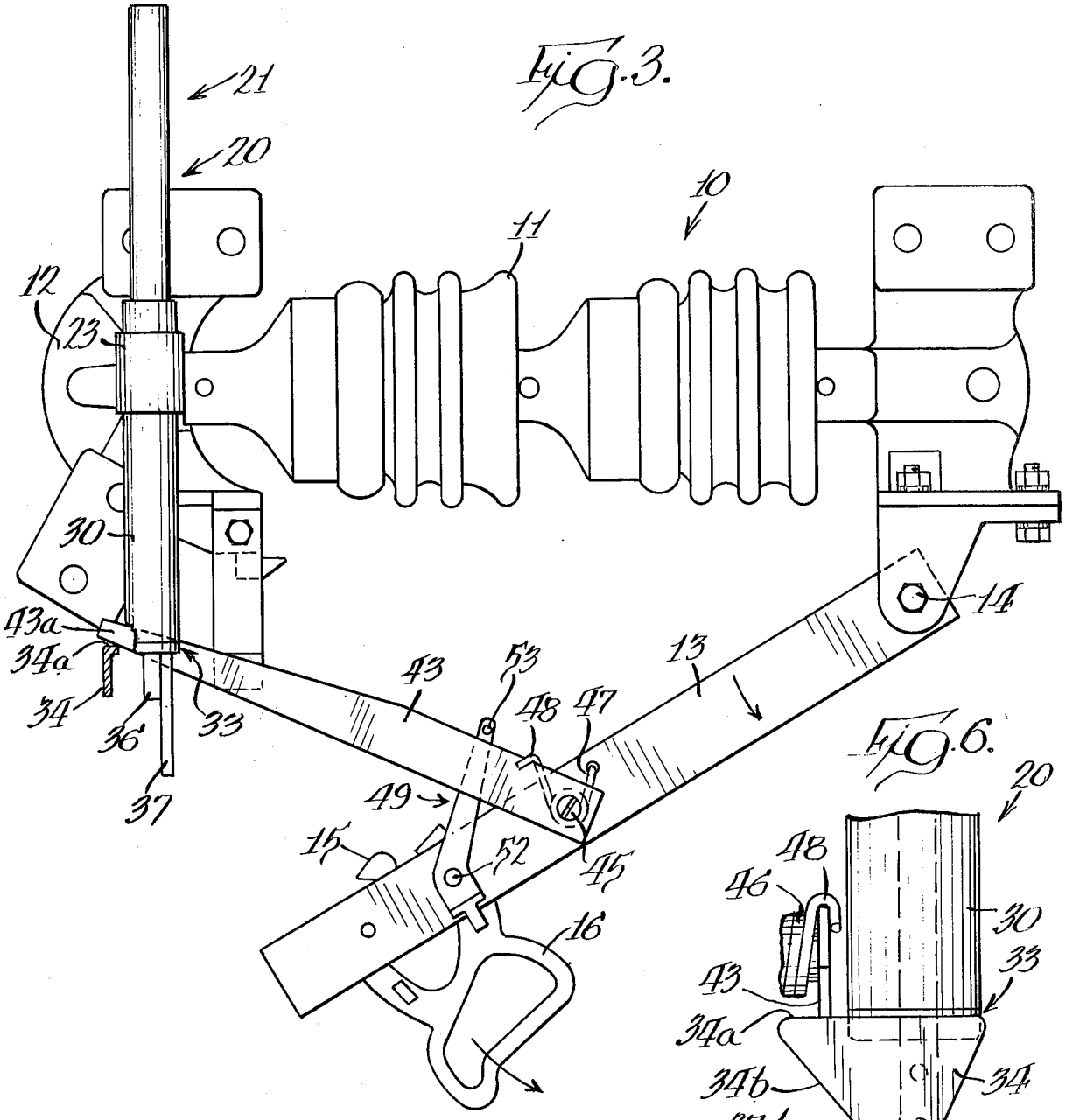
FIG. 3 is a side elevational view of the apparatus of the invention, partly in section and with a part broken away, illustrating the position of the parts immediately before the interrupter is actuated.

Also forming a part of the interrupter operating means 40 is a stop assembly, indicated generally at 49, which is best seen in FIGS. 2, 3 and 4, and which is omitted from FIG. 5 for clarity of illustration of the operating arm 43 and the torsion spring 46. The stop assembly 49 is mounted upon the outer end of a laterally projecting portion of a pin 50 which also serves as a part of the latch means 15 of the movable contact structure 13. The stop assembly 49 has a hub 51 which surrounds the outer end portion of the pin 50 and has a first integral stop member 52 which is below the interrupter operating arm 43, and a second integral stop member 53 which is above said operating arm. Thus, the bias of the torsion spring 46 holds the operating arm 43 against the lower stop member 52, while the upper stop member 53 confines the operating arm and serves as a backup member which causes the operating arm 43 to perform its function of actuating the interrupter even if the torsion spring 46 is broken. As best seen in FIG. 1, the lower stop member 52 normally retains the interrupter operating arm 43 in alignment with the movable contact structure 13 and close enough to the fixed catch 34 that as the movable contact structure 13 is started toward open position the arm engages the upper surfaces 34a of the fixed catch while the electrical circuit is still closed through the movable contact structure 13 and the fixed contact structure 12.

Engagement of the interrupter operating arm 43 with the fixed catch 34 completes a circuit through the guide 33, the movable interrupter actuating rod 36, the movable interrupter contact 35, the fixed interrupter contact 27, the housing 23 and the bracket 24 to the fixed contact structure 12 of the switch. This prevents arcing as the movable contact structure 13 is separated from the fixed contact structure 12.

As the movable contact structure 13 is pulled toward the partially open position of FIG. 3 the lower surface of the operating arm 43 slides over the upper surface 34a of the fixed catch until the gap between the movable contact structure 13 and the fixed contact structure 12 is large enough to prevent arcing between them. At that point, the outer extremity 43*a* of the operating arm 43 slides off the fixed catch 34 and the torsion spring 46, which at that point is heavily stressed, drives the operating arm 43 rapidly and forceably against the actuating catch 37 so that it drives the movable interrupter contact assembly rapidly to the fully extended position of FIG. 4. This breaks the circuit through the interrupter contact, 35 and 37, and pulls an arc inside the interrupter housing which is quenched by the action of the liner 31. The circuit is momentarily broken as the arm 43 moves off the fixed catch 34 onto the actuating catch 37, but the break is so brief that it causes no damage.

As the movable contact structure 13 passes through the full line position of FIG. 4, the extremity 43*a* of the operating arm 43 rides off the top surface 37*a* of the actuating catch 37, and the spring 39 returns the movable interrupter contact assembly 22 to its normal position seen in FIG. 5. The movable contact structure 13 terminates its movement substantially in the broken line position of FIG. 4, with the operating arm 43 again bearing upon the lower stop member 52.

As the movable contact structure 13 is returned from the open position of FIG. 4 to the normal, closed position of FIG. 1, the upper surface of the operating arm 43 strikes the inclined camming surface 37*b* of the actuator catch 37, as seen in broken lines in FIG. 5. The arm is fabricated of sufficiently resilient material that it can flex around the nose 37*c* of the actuating catch 37, as illustrated by the broken line arrow in FIG. 5, after which it contacts the inclined cam surface 34*b* of the fixed catch 34 and flexes around it, returning to the full line position of FIG. 5 in which it is aligned with the planar top surface 34*a* of the fixed catch 34 as the movable contact structure 13 returns to its closed position. During return to the closed position the circuit is first completed through the operating arm 43 and the interrupter so that any arcing upon closing is between the arm and the catches 37 and 34, all of which are relatively inexpensive and readily replaceable.

It is to be noted that the quick return of the movable interrupter contact assembly 22 to its normal position, by the spring 39, and the rapid movement of the operating arm 43 to its position against the stop member 52 by the torsion spring 46, almost instantaneously produces a large enough gap between the actuating catch 37 and the arm 43 that there can be not arcing across them until the movable contact structure 13 is being returned to its closed position.

The foregoing detailed description is given for clearness of understanding only and no unnecessary limitations should be understood therefrom, as modifications will be obvious to those skilled in the art.

I claim:

1. An electrical disconnect switch and circuit interrupter comprising, in combination:
- a switch body including a fixed electrical contact structure;
- a movable electrical contact structure pivoted on said switch body for movement in a path between a closed position engaging the fixed contact structure, and an open position spaced from said fixed contact structure;
- an elongate, tubular circuit interrupter assembly housing which has a lining of arc-extinguishing material;
- a fixed electrical interrupter contact in said housing;
- a movable electrical interrupter contact in said housing which occupies a normal position abutting said fixed interrupter contact and has an integral electrically conductive actuating rod projecting out an end of the housing;
- a bracket supporting said housing on the fixed contact structure and providing an electrically conductive path between the fixed interrupter contact and the fixed contact structure;
- a fixed catch on the exterior of the housing which is electrically connected to the actuating rod;
- an actuating catch on the outer end of the actuating rod adjacent said fixed catch;
- and an electrically conductive interrupter operating arm on the movable contact structure, said operating arm being positioned to move in a path in which it sequentially engages the fixed catch and the actuating catch during movement of the movable contact structure from closed position, and serving to separate the movable interrupter contact from the fixed interrupter contact after the movable contact structure is sufficiently spaced from the fixed contact structure to avoid arcing between said structures.

2. The combination of claim 1 in which the operating arm is pivotally mounted on an axis parallel to the movable contact pivot and is biased in the direction of movement of the movable contact structure from closed position, and a stop on said movable contact structure restricts pivoting of said arm in said direction.

3. The combination of claim 2 which includes a second stop restricting movement of the arm in the opposite direction.

4. The combination of claim 1 in which the bracket projects laterally from the fixed contact structure, the longitudinal axis of the interrupter housing is parallel to the path of the movable contact structure, a mounting member projects laterally from the movable contact structure, and the operating arm is carried on the outer end portion of said mounting member adjacent the housing.

5. The combination of claim 4 in which the operating arm is pivoted on the mounting member for movement in a plane parallel to the path of the movable contact structure, a torsion spring embraces the mounting member and biases the operating arm in the direction of movement of the movable contact structure from closed position, and a stop on said movable contact structure restricts pivoting of said arm in said direction.

6. The combination of claim 5 which includes a second stop restricting movement of the arm in the opposite direction.

7. The combination of claim 1 which includes means detachably mounting the interrupter housing on the fixed contact structure.

8. The combination of claim 7 in which said detachably mounting means detachably secures the bracket to the fixed contact structure.

9. The combination of claim 1 in which the fixed catch and the actuating catch have surfaces engaged by the operating arm which are effectively normal to the path of said arm, in which said catches have camming faces inclined to the return path of the arm, and in which the arm has sufficient resilience to slide over said camming faces during return of the movable switch member to closed position.

10. The combination of claim 1 which includes a spring biasing the movable interrupter contact toward its normal position.

11. The combination of claim 1 in which the movable interrupter contact has a stem of dielectric material extending in a direction opposite to the operating rod, and a spring operatively connected to said stem biases said movable interrupter contact toward its normal position.

12. The combination of claim 1 in which an electrically conductive plug in said end of the housing has a guide hole in which the actuating rod slides, and the fixed catch is integral with said plug.

13. The combination of claim 1 in which the relationship between the fixed catch and the actuating catch and the length of the operating arm are such that the end of the operating arm slides off the fixed catch onto the actuating catch when the movable contact structure is spaced sufficiently from the fixed contact structure.

14. The combination of claim 13 in which the operating arm is pivotally mounted on an axis parallel to the movable contact pivot and is biased in the direction of movement of the movable contact structure from closed position, a stop on said movable contact structure restricts pivoting of said arm in said direction, said spring being stressed as the movable contact moves from closed position and the operating arm is held by engagement with the fixed catch, whereby the spring rotates said arm rapidly as the latter slides off said fixed catch.

15. The combination of claim 14 which includes a second stop restricting movement of the arm in the opposite direction.

16. The combination of claim 15 in which an electrically conductive plug in said end of the housing has a guide hole in which the actuating rod slides, and the fixed catch is integral with said plug.

17. An electrical circuit interrupter which is adapted to be mounted upon a fixed electrical contact structure of an electrical disconnect switch that has a pivoted movable electrical contact structure provided with an electrically conductive interrupter operating arm engageable with parts of said interrupter to operate the latter as the movable contact structure is pivoted between a closed position and an open position, said interrupter comprising, in combination:

an elongate, tubular housing which has a lining of arc-extinguishing material;

means for mounting said housing upon a fixed electrical contact structure;

a fixed electrical interrupter contact in said housing which is electrically connected to said mounting means, a movable electrical interrupter contact in said housing which occupies a normal position abutting said fixed interrupter contact and has an integral electrically conductive actuating rod projecting out an end of the housing;

a fixed catch on the exterior of the housing which is electrically connected to the actuating rod; and an actuating catch on the outer end of the actuating rod adjacent said fixed catch;

said catches, when the interrupter is mounted upon a fixed contact structure of an electrical disconnect switch, being positioned to be sequentially engaged by an operating arm of said disconnect switch to separate the movable interrupter contact from the fixed interrupter contact after the movable contact structure is sufficiently spaced from the fixed contact structure to avoid arching between said structures.

18. The combination of claim 17 in which the means for mounting the housing comprises a bracket of electrically conductive material secured to the housing, and means for detachably securing said bracket to the fixed contact structure.

19. The combination of claim 17 in which the fixed catch and the actuating catch have surfaces engaged by the operating arm which are effectively normal to the path of said arm, in which said catches have camming faces inclined to the return path of the arm, and in which the arm has sufficient resilience to slide over said camming faces during return of the movable switch member to closed position.

20. The combination of claim 17 which includes a spring biasing the movable interrupter contact toward its normal position.

21. The combination of claim 17 in which the movable interrupter contact has a stem of dielectric material extending in a direction opposite to the operating rod, and a spring operatively connected to said stem biases said movable interrupter contact toward its normal position.

22. The combination of claim 17 in which an electrically conductive plug in said end of the housing has a guide hole in which the actuating rod slides, and the fixed catch is integral with said plug.

23. The combination of claim 17 in which the relationship between the fixed catch and the actuating catch and the length of the operating arm are such that the end of the operating arm slides off the fixed catch when the movable contact structure is spaced sufficiently from the fixed contact structure.

24. An electrical disconnect switch which is adapted to receive and operate a circuit interrupter that is mounted on a fixed contact structure of the switch laterally spaced from and parallel to the path of movement of a movable contact structure of the switch, and which interrupter has a housing with a fixed interrupter contact, a movable interrupter contact, a fixed catch, and an actuating catch on the movable interrupter contact adjacent the fixed catch for operating the interrupter, said disconnect switch comprising, in combination:

a switch body including a fixed electrical contact structure;

a mounting pad on one side of said fixed contact structure to receive an interrupter bracket in a laterally projecting position;

a movable electrical contact structure pivoted on said switch body for movement in a path between a closed position engaging the fixed contact structure, and an open position spaced from said fixed contact structure;

a mounting member projecting from the side of the movable contact structure which corresponds to that side of the fixed contact structure having the mounting pad;

an interrupter operating arm pivotally mounted at the outer end of said mounting member for movement in a plane parallel to that of the movable contact structure;

means biasing said arm in the direction of movement of the movable contact structure from closed position;

and a stop mounted on said movable contact structure to limit the pivotal movement of said arm in said direction.

25. The combination of claim 24 which also includes a second stop restricting movement of said arm in the opposite direction.

26. The combination of claim 25 in which said stop and said second stop integral fingers perpendicular to a base, and a rod mounts said base on the movable contact structure.

27. The combination of claim 24 in which the length of the operating arm and its relationship to the interrupter are such that it first engages the fixed catch on an interrupter which arrests its movement as the movable contact structure is moved from closed position, thereby stressing the arm biasing means, and said relationship further being such that its end slides off the fixed catch and it engages the movable interrupter contact actuating catch after the movable contact structure is far enough from the fixed contact structure to avoid arching between said structures.

28. The combination of claim 27 which also includes a second stop restricting movement of said arm in the opposite direction.

* * * * *